US006085536A

United States Patent [19]

Evans, Sr.

[11] Patent Number: 6,085,536

[45] Date of Patent: Jul. 11, 2000

[54] ENVIRONMENTALLY ADAPTIVE VAC EXTERIOR HEAT EXCHANGE UNIT

[76] Inventor: Fred Evans, Sr., 2005 Gainsborough Rd., Rockville, Md. 20851

[21] Appl. No.: 09/372,830

[22] Filed: Aug. 12, 1999

[51] Int. Cl.[7] ..... F25D 23/12

[52] U.S. Cl. ..... 62/259.1; 62/430; 62/434; 165/154

[58] Field of Search ..... 62/259.1, 430, 62/434; 65/154, 45, 163, 140

[56] References Cited

U.S. PATENT DOCUMENTS 5,706,888 1/1998 Ambs et al. ..... 165/45 X

*Primary Examiner*—Henry Bennett
*Assistant Examiner*—Chen-Wen Jiang
*Attorney, Agent, or Firm*—Joseph J. Zito

[57] ABSTRACT

An environmentally adaptable exterior heat exchange unit with a pot like base and a vertical component extending from the base. An artificial plant is incorporated into the structure to blend the unit with its environmental surroundings. The unit could resemble a fir tree, a shrub, a bush, a tree or the like. A compressor and condensing coil are located within the base which will reduce noise levels and increase efficiency of heat exchange. A set of vertically extending heat exchange coils circulate a second coolant and extend upward from the base and can be moved relative to the base without disturbing coolant flow or the components housed within the base. The unit can be operated with the lid off and mainatin refrigerant and coolant circulation. The refrigerant coil is run within the coolant coil in a tube-in-tube arrangement within the base to enhance heat exchange. The coolant tubes then carry the heat outside the base. A blower is provided to enhance heat exchange between the vertical coolant coil and the air as necessary. The base can be buried as desired for visual enhancement and/or noise reduction.

19 Claims, 5 Drawing Sheets

ENVIRONMENTALLY ADAPTIVE VAC EXTERIOR HEAT EXCHANGE UNIT

BACKGROUND OF THE INVENTION

The present invention relates to heat exchanger and air conditioner condenser units. More specifically, the present invention relates to an environmentally adaptive construction for the external unit of an VAC system.

Prior external heat exchange units for VAC systems have been generally round (D226,914; D274,353; D276,843; D357,309) or square (U.S. Pat. Nos. 3,722,845; 4,261,418; 4,470,271; 5,117,656; 5,660,054; 5,619,863) configured with a set of heat exchange coils generally surrounding the compressor and fan and largely defining the overall shape of the unit. Some units are designed to allow the exterior unit to be housed within a building in a confined space U.S. Pat. Nos. 5,271,242 and 5,619,864, while others are designed to become part of the building U.S. Pat. No. 5,551,508 and 5,095,716.

It is often difficult to place external units in a location in relation to a building where the presence of the unit will not be intrusive. This can present obstacles to the full and effective use of the exterior spaces of a structure. Large, above ground units are not only visually intrusive but can also create significant unwanted noise levels.

SUMMARY OF THE INVENTION

It is an object of the present invention to provide an environmentally adaptive external unit for an HVAC system which will blend visually with the surroundings while providing efficient and effective heat exchange.

It is a further object of the present invention to provide an external HVAC unit which can be used to architecturally enhance the exterior of a structure.

It is yet a further object of the present invention to provide a device which is efficient by utilizing tube-in-tube heat exchange to enhance heat transfer.

It is another object of the present invention to provide a device which is efficient by utilizing elongated end feed tubes to enhance heat transfer.

The heat exchange unit taught in the exemplary embodiment described herein satisfies these and other objects by providing an external heat exchange unit in the configuration of a potted tree. A compressor is situated within a large pot-shaped housing. In a preferred embodiment, a tube-in-tube heat exchange coil is provided within the housing to transfer heat from the refrigerant to a second heat exchange fluid medium. Elongated heat exchange tubes extend vertically upward from the top of the housing for circulation of the second heat exchange fluid. Alternatively, the tube-in-tube coil can be eliminated and the refrigerant can be circulated through the elongated heat exchange tubes to transfer heat to the ambient air. A fan is integrated into the housing lid to provide air circulation within the housing and across the elongated heat exchange tubes. An artificial tree extends above the housing to obscure the view of the elongated heat exchange tubes. Baffling can be provided within the elongated tube structure to enhance air flow and thereby enhance heat exchange.

BRIEF DESCRIPTION OF THE DRAWINGS

For a better understanding of the nature of the present invention, reference is made to the following figures and detailed description, wherein like elements are accorded like reference numerals, and wherein.

DETAILED DESCRIPTION OF PREFERRED EXEMPLARY EMBODIMENTS

Figure 1:
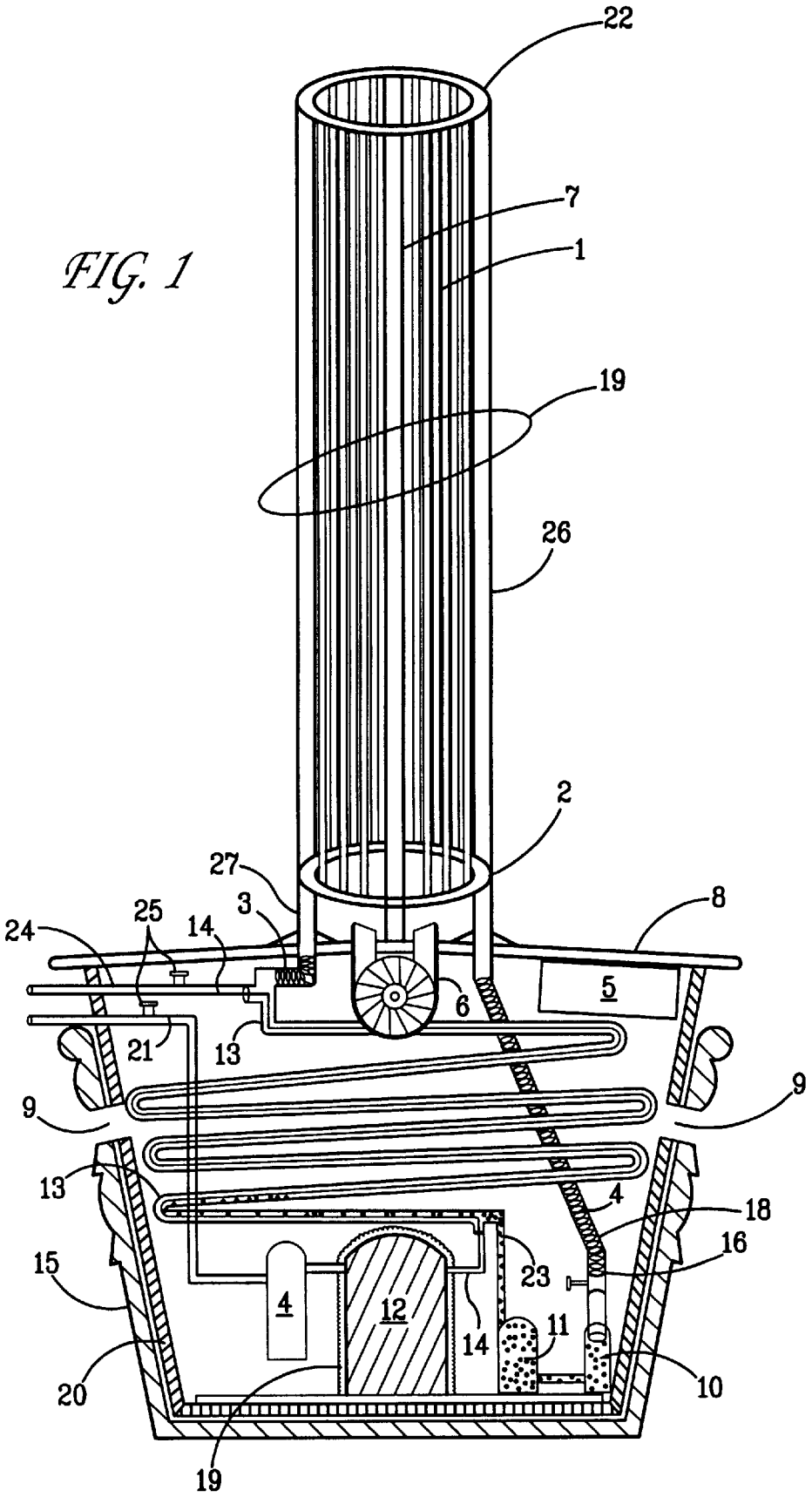
FIG. 1 is a side view of the first embodiment of the present invention illustrating a cut-away view of the housing.

The heat exchange unit, FIG. 1, includes a base 15 which acts as a base for the inner liner housing 20. The base 15 can be made of any suitable material, including solid foam or other insulating material. The base 15 can be buried into the ground to reduce its visible size and/or to reduce the noise associated with the compressor 12 and coolant pump 11. Compressor 12 can be provided with a cover 19 to reduce noise if desired. The base 15 should not be covered up to or over air passage circulation holes 9. The housing liner 20 fits within the base 15 and includes corresponding air passage circulation holes 9.

The compressor 12, recovery tank 4, coolant pump 11 and receiver 10 are all situated toward or on the bottom of liner 20.

The refrigerant enters the outdoor heat exchanger unit through suction line 21. The refrigerant then runs through inner tube 14 of tube-in-tube coil 13 and exits out the exit line 24. Liquid coolant is pumped through outer tube 23 of tube-in-tube coil 13 by pump 11.

Figure 5:
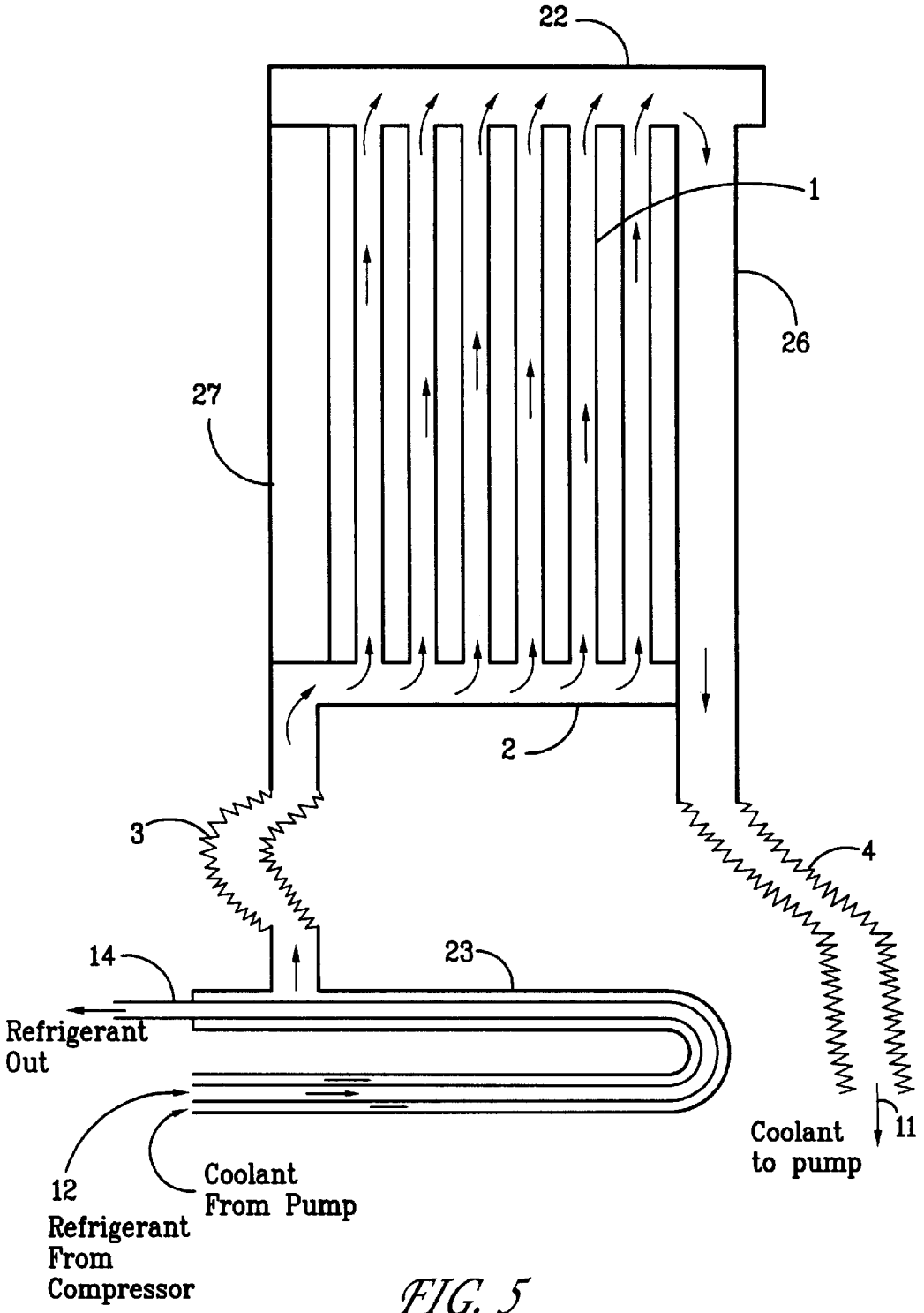
FIG. 5 is a diagrammatic view of the vertical tube array and the tube-in-tube heat exchanger, illustrating the flow path of the refrigerant and the liquid coolant.

The liquid coolant exits the tube-in-tube coil 13 through flexible tube 3 which connects to vertical tubing 27 and into lower end manifold 2. As better illustrated in FIG. 5, the liquid coolant flows into lower manifold 2 and is then distributed to the plurality of vertical tubes 1. The coolant flows through the tubes 1 and exchanges heat with the surrounding air. Fan 6 can be provided to circulate air over the tubes 1 to enhance heat exchange if desired. Operation of fan 6 will also circulate air through the housing 20. The coolant then enters upper manifold 22 and returns to receiver 10 through return tube 26, flexible tube 4 and relief valve 16. Support 7 is provided to receive and support a tree or bush. Support 7 receives the trunk of a simulated tree or bush, the branches are then inserted between the vertical tubes 1 and into the trunk.

Alternatively, the vertical tube heat exchanger 19 can be operated with a refrigerant such as Freon instead of a liquid coolant. However, such arrangement may require an increased blower for air circulation to achieve appropriate heat exchange.

The vertical tube structure 19 is mounted to lid 8. Blower 6 is mounted to lid 8 below the vertical structure 19 and draws air from below the lid 8 and expels air vertically above lid 8. Lid 8 is removable for servicing of the unit. Lid 8 can be attached to the housing liner 20 by one or more clips or hinges. When lid 8 is opened, all of the internal components remain in place. Flexible tubes 3 and 4 allow the lid to be hinged open without disconnection of the coolant tubes 27 and 26. Flexible tubes 3 and 4 lengthen to allow repositioning of the lid 8 during servicing. Service ports 25 and control box 5 are located near the opening of the housing liner 20 for access.

Figures 2A, 2B, 2C, 2D:
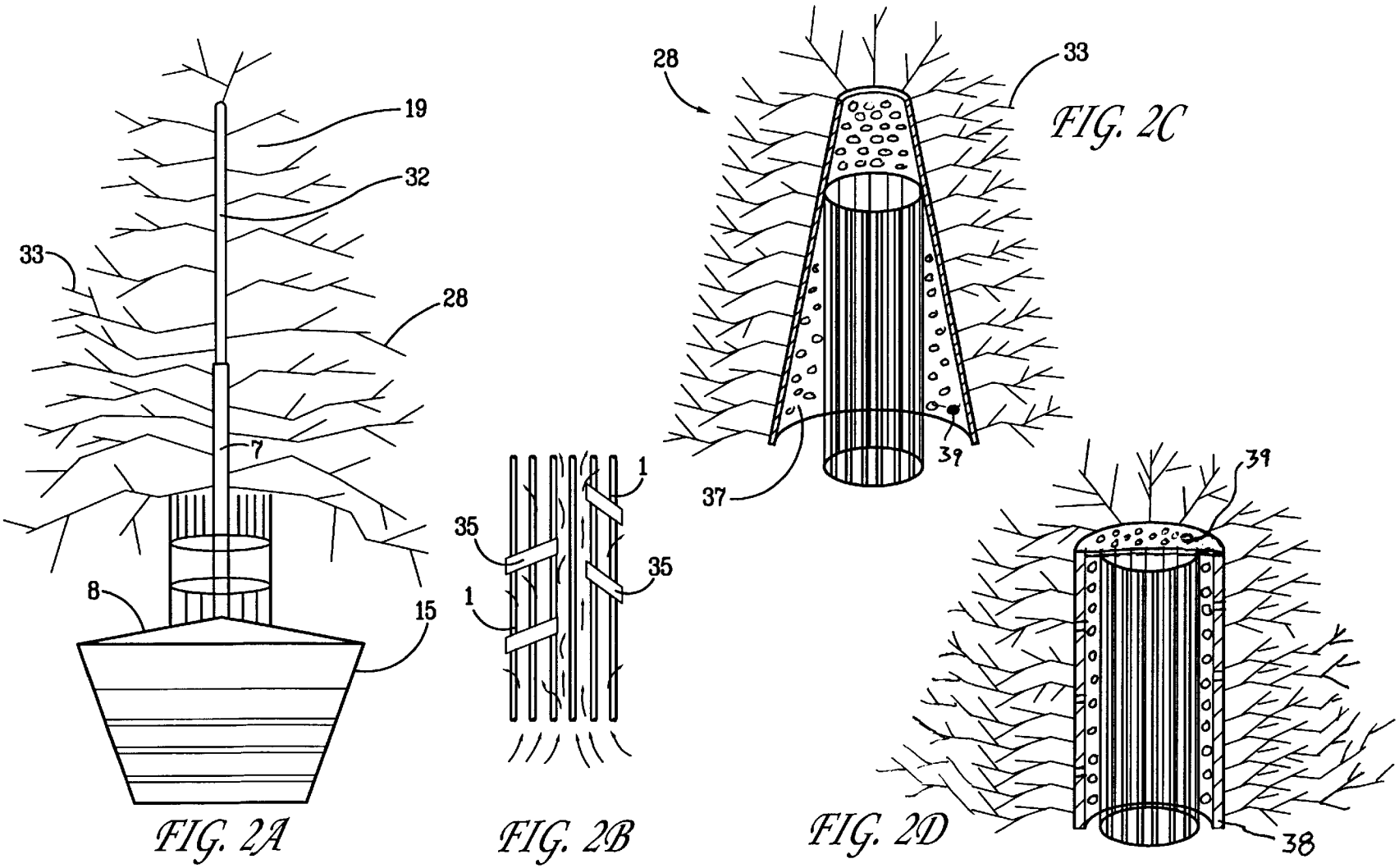
FIG. 2A is an overall view of an embodiment of the present invention configured to resemble a fir tree.
FIGS. 2B–2D are alternative views of embodiments of the present invention.
Figure 3:
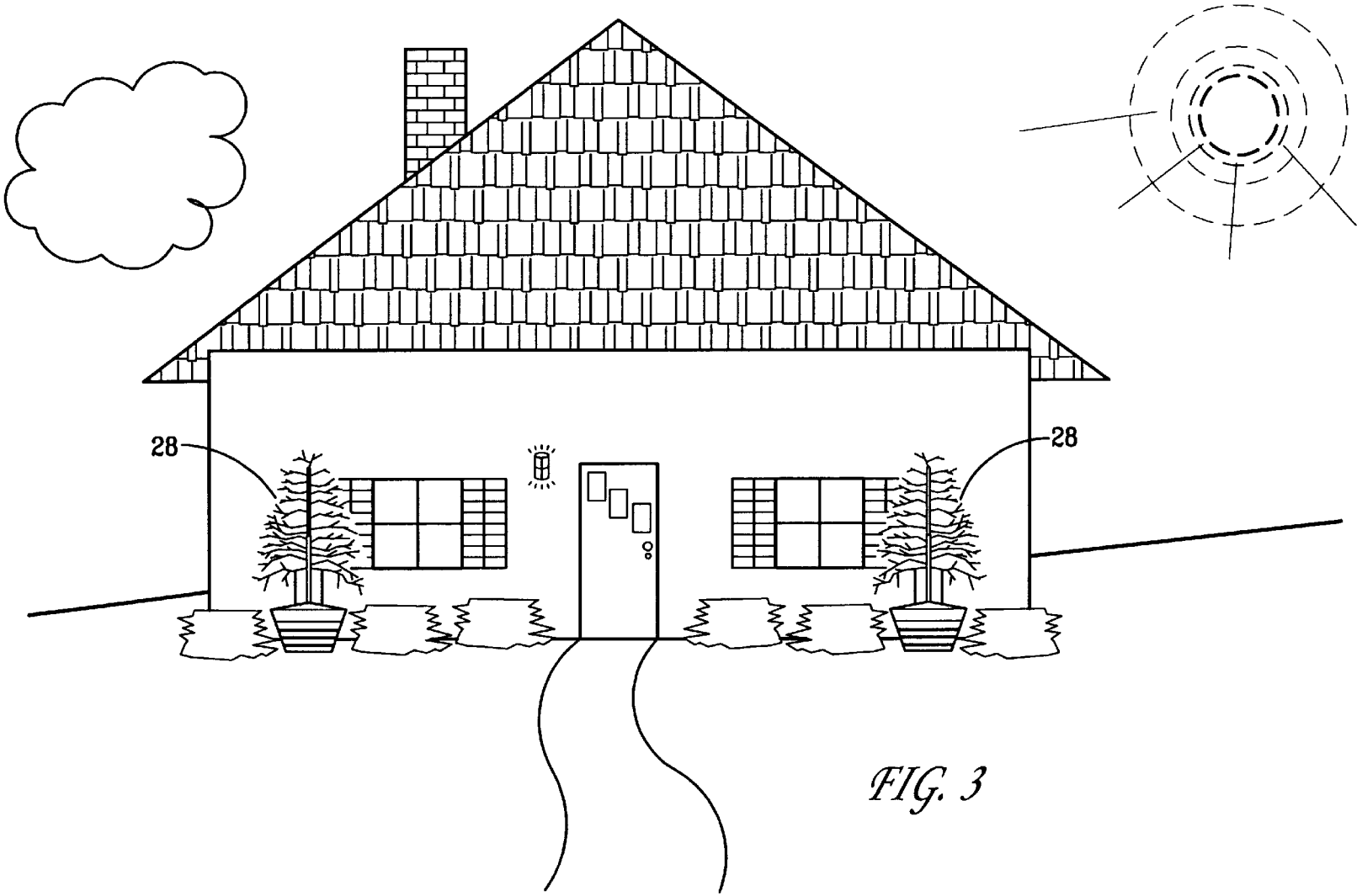
FIG. 3 is an overall view of two units of a second embodiment of the present invention installed adjacent to a structure.

As illustrated in FIGS. 2 and 3, an artificial plant 28, such as a tree, a bush or shrub can be placed around the vertical tube heat exchanger 19 to reduce the visual impact of the unit. The branches 33 of the tree 28 are inserted between the vertical tubes 1 and into the tree trunk 32 secured to support 7. Because thick branches or leaves or needles could impede air flow vertically within the heat exchange tubes 19, the inner portions of the branches 33 can be thinned to remove potential airflow obstructions.

Air flow will follow the path of least resistance, and therefore may, in the absence of restriction, have a tendency to flow vertically for a short distance and then spread horizontally outward. In the flow configuration, the air may pass primarily over the lower portion of the vertical heat exchange tubes, reducing the effective heat transfer. In order to further enhance flow design, FIG. 2B, an optional baffle structure 35 can be positioned within the tube structure to confine and redirect air flow inward and upward along the tubes before the air exits between the tubes 1.

In alternative embodiments, FIGS. 2C and 2D, the tree 28 includes an inner structure, cone 37 or cylinder 38, illustrated in cross section, from which the branches 33 extend. This inner conical baffle 37 or cylindrical baffle 38 confines the air to flow through and along the length of all tubes in the structure 19 and exit passing between vertical tubes 1 and out through the baffle, providing enhanced air flow and heat exchange. Baffle 37 and 38 can be made of mesh, allowing for air flow, or can include holes 39 for air flow.

The tube-in-tube heat exchanger is housed within the base 15 and liner 20, allowing the vertical tube heat exchanger 19 to extend above the unit. The configuration is well adapted to blending into the surrounding environment.

Figure 4:
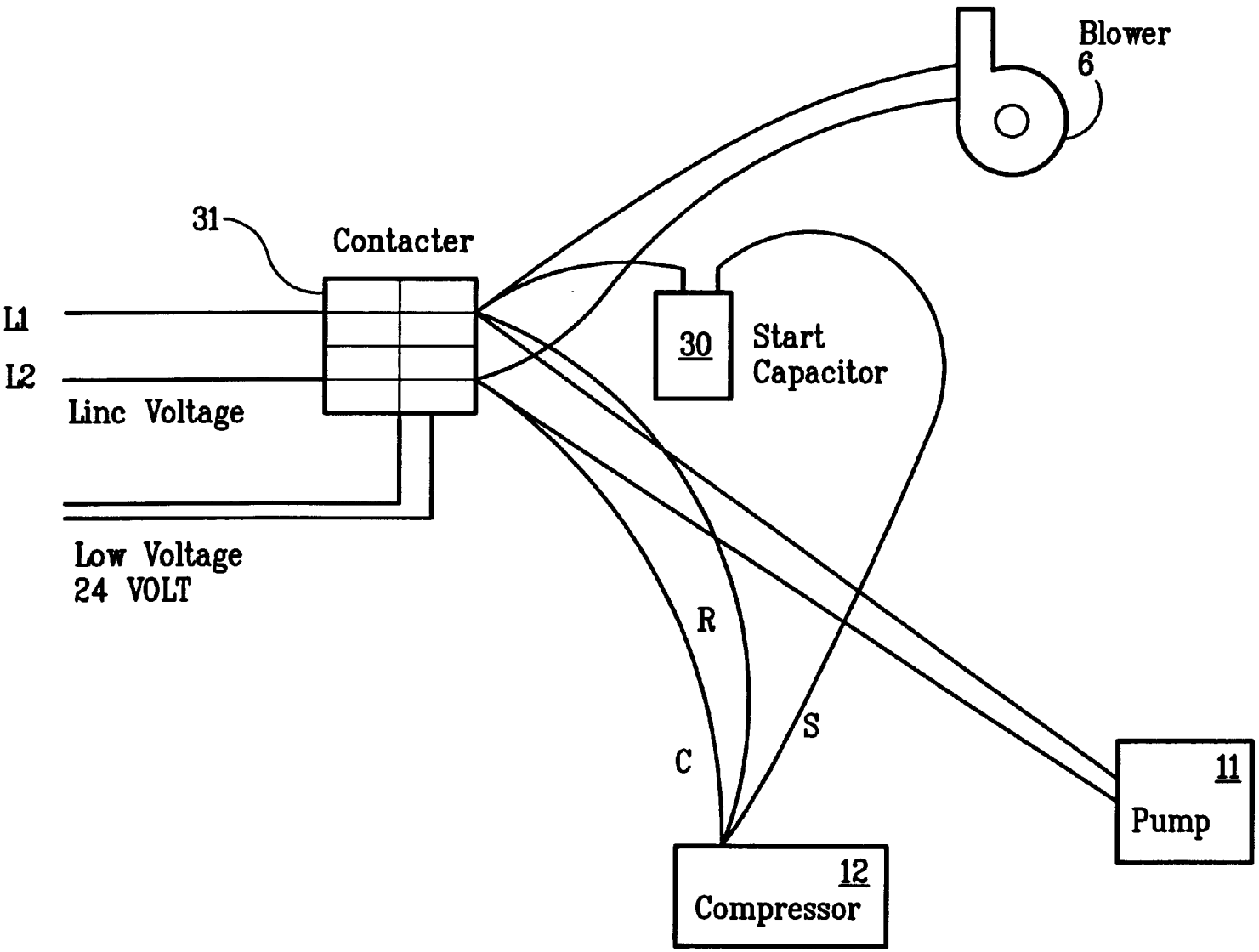
FIG. 4 is an exemplary wiring diagram of an exemplary embodiment of the present invention.

FIG. 4 illustrates the electrical wiring of the unit which is accomplished in the same manner as a conventional exterior heat exchange unit, except that the coolant pump 11 must also be connected and controlled by controller 31 as well as the compressor 12, blower 6 and start capacitor 30.

In an exemplary embodiment of the present invention, a two ton, two horsepower compressor unit 12 at 230 volts utilizing R22 refrigerant is housed in a twenty-one inch high, twenty-two inch diameter housing 20. The housing 20 is provided with 1¾ inch diameter ventilation holes 9 spaced around the housing to provide ten to fifteen openings. A tube 14 in tube 13 heat transfer coil of ⅜ inch tubing 14 inside ¾ inch tubing 13 for a length of twenty five feet is connected to a 15 psi, twenty foot lift circulation pump 11 for the liquid coolant. The liquid is circulated through a vertical heat exchange array 19 of ten inch diameter manifolds 2 and 22 of ¾ inch tubing. The vertical tubes 1 are ¼ inch tubes and the return manifold 26 and support 27 are ¾ inch tubing. Two 320 CFM fans 6 provide air circulation over the vertical array 19. A sixty-four inch high fir tree 28 with a thirty six inch diameter base provides environmental blending for the unit.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. An exterior heat exchange unit, comprising a base;

a compressor for circulating a refrigerant located within said base;

a tube-in-tube heat exchange coil located within said base, and having an first coil for circulation of said refrigerant and an second coil for circulation of a separate coolant in heat exchange with said refrigerant;

a vertically extending heat exchanger extending upward from the base, for circulation of said separate coolant in heat exchange with the environment.

2. The exterior heat exchange unit of claim 1, further comprising:

an air blower for circulating air over said vertically extending heat exchanger to enhance heat exchange between said separate coolant and said environment.

3. The exterior heat exchange unit of claim 1, wherein:

said vertically extending heat exchanger includes a set of vertically extending heat exchange tubes.

4. The exterior heat exchange unit of claim 3, wherein:

said vertically extending heat exchanger further includes a lower manifold for distributed feeding of said coolant to each of said tubes in said set of tubes and an upper manifold for collecting said coolant from each of said tubes and a return manifold for returning said coolant to said tube-in-tube heat exchanger.

5. The exterior heat exchange unit of claim 4, further including:

a pump for circulation of said coolant through said exterior tube and said vertical heat exchanger.

6. The exterior heat exchange unit of claim 1, further including:

flexible tubing connecting said vertically extending heat exchanger with said tube-in-tube heat exchanger.

7. The exterior heat exchange unit of claim 6, wherein said vertically extending heat exchanger can be moved relative to said base without disturbing coolant flow or the components housed within said base.

8. The exterior heat exchange unit of claim 6, wherein said unit can be operated independent of the relative orientation of said vertically extending heat exchanger and said base.

9. The exterior heat exchange unit of claim 6, wherein said unit can be operated with said vertically extending heat exchanger in a horizontal orientation.

10. The exterior heat exchange unit of claim 1, further including an artificial plant extending vertically from said base, essentially parallel and concentric with said vertically extending heat exchanger.

11. The exterior heat exchange unit of claim 1, wherein:

said vertically extending heat exchanger forms an elongated open cylinder.

12. The exterior heat exchange unit of claim 11, further comprising:

an air blower for circulating air axially through said cylinder and radially outward over said vertically extending heat exchanger.

13. The exterior heat exchange unit of claim 12, further comprising:

at least one baffle for directing said air flow radially inward and axially upward through said cylinder.

14. The exterior heat exchange unit of claim 1, further including:

a conical baffle substantially enclosing said vertically extending heat exchanger for directing said air flow substantially vertically along said heat exchanger.

15. The exterior heat exchange unit of claim 1, further including:

a cylindrical baffle substantially enclosing said vertically extending heat exchanger for directing said air flow substantially vertically along said heat exchanger.

16. The exterior heat exchange unit of claim 15, further including:

baffling within said elongated heat exchange structure to enhance air flow and thereby enhance heat exchange.

17. An exterior heat exchange unit having a compressor and a circulation circuit for a refrigerant in fluid communication with an interior unit, comprising:

a pot shaped housing;

a heat exchange coil within said housing to transfer heat from said refrigerant to a second heat exchange fluid medium;

a vertically elongated heat exchange circuit extending vertically upward from the top of said housing for circulation of said second heat exchange fluid in heat exchange communication with ambient air;

a fan operatively mounted to said top of said housing to provide air circulation across said heat exchange circuit;

an artificial tree extending from said housing top substantially parallel, surrounding and essentially coextensive with said vertically elongated heat exchanger.

18. An exterior heat exchange unit having a compressor and a circulation circuit for a refrigerant in fluid communication with an interior unit, comprising:

a pot shaped housing;

a heat exchange coil partially within said housing and including a vertically elongated heat exchange circuit extending vertically upward from the top of said housing, for circulation of said refrigerant in heat exchange communication with ambient air;

a fan operatively mounted to said top of said housing to provide air circulation across said heat exchange circuit;

an artificial tree extending from said housing top substantially parallel, surrounding and essentially coextensive with said vertically elongated heat exchanger.

19. The exterior heat exchange unit of claim 18, further including:

baffling within said elongated heat exchange structure to enhance air flow and thereby enhance heat exchange.

* * * * *